United States Patent [19]

Suzuki et al.

[11] Patent Number: 5,048,687

[45] Date of Patent: Sep. 17, 1991

[54] HEAT-SHRUNK PROTECTIVE PACKAGING FOR MULTIPLE UNITS

[75] Inventors: Migaku Suzuki; Kazuo Ito, both of Kamakura; Chikako Minai, Yokohama; Hiromi Takeda, Musashino, all of Japan

[73] Assignee: Weyerhaeuser Company, Tacoma, Wash.

[21] Appl. No.: 512,706

[22] Filed: Apr. 23, 1990

[51] Int. Cl.[5] ..... B65D 71/08; B65D 65/28

[52] U.S. Cl. ..... 206/497; 206/499; 206/620; 206/634; 221/305

[58] Field of Search ..... 206/499, 526, 497, 44.12, 206/605, 606, 620, 621, 627, 628, 634, 610, 614; 221/305, 309; 229/87.05

[56] References Cited

U.S. PATENT DOCUMENTS

| | | | |
|---|---|---|---|
| 1,329,056 | 1/1920 | Mesler | 206/627 X |
| 2,020,799 | 11/1935 | Randall | 206/628 X |
| 2,835,378 | 5/1958 | Sramek | 206/620 X |
| 2,867,368 | 1/1959 | Kaplan | 206/620 X |
| 2,981,455 | 4/1961 | Cope | 206/606 |
| 3,014,634 | 12/1961 | Humphrey et al. | 206/620 |
| 3,047,140 | 7/1962 | Robins | 206/497 X |
| 3,141,602 | 7/1964 | Anderson | 229/87.05 |
| 3,237,837 | 3/1966 | Vizethann | 206/620 |
| 3,273,302 | 9/1966 | Walter | 206/497 X |
| 3,286,830 | 11/1966 | Robb, Jr. | 206/621 X |
| 3,315,875 | 4/1967 | Praetorius | 206/44.12 |
| 3,458,036 | 7/1969 | James | 206/497 |
| 3,804,235 | 4/1974 | Anderson | 206/497 |

FOREIGN PATENT DOCUMENTS

| | | | |
|---|---|---|---|
| 0074495 | 6/1977 | Japan | 206/497 |
| 59-196459 | 12/1984 | Japan . | |

*Primary Examiner*—Bryon P. Gehman

[57] ABSTRACT

A number of inner packages are formed into a unit and wrapped in an outer package. The combination of the inner and outer packages allows the package to hold its shape after the outer package is opened. The outer package is formed by wrapping the inner package unit in a tubular outer wrap, and sealing the top and bottom surfaces. The outer wrap, or at least the material for the top and bottom panels of the outer package, is made of a contractible or heat shrinkable flexible plastic film which is contracted or heat shrunk to maintain and hold the inner package unit in a tightly packed condition. Deformation of the outer package is more effectively prevented and makes the outer package easy to handle. An opening in the outer package is formed by perforation lines in two side panels and a top or bottom panel. The perforation lines may extend the entire height of the outer package. The panel sections between these perforation lines form dust flaps after opening. The outer package is opened and the inner packages are removed individually.

7 Claims, 4 Drawing Sheets

HEAT-SHRUNK PROTECTIVE PACKAGING FOR MULTIPLE UNITS

BACKGROUND OF THE INVENTION

This invention is related to a package for wrapping hygienic products such as disposable diapers.

A package for disposable diapers in general use in Japan and disclosed in Japanese Patent Application No. 59 [1984]-196459, was provided with a sheet of plastic film covering the side surfaces of the tubular main body of the package, a cutout section at the center area through which a carrier's fingers were passed, and a perforated opening line on the upper surface of this tubular main body. Another recent package is a large package that is packed with enough disposable diapers for several weeks use.

There are a number of problems with this type of package. The package does not retain its shape once a package of this type is opened along the perforated line because the plastic film does not support itself. In particular, the larger the package is the more the package loses it shape, and the more the diapers inside get separated from each other, fall down, and scatter within the package as additional diapers are taken out of the package. It is difficult to find storage space for the package. The common material for this type of package is high-density polyethylene, which is easily torn, so the package opening becomes widened as time passes, and packed diapers come out of the package. This type of package generally has no means for preventing dust from coming in after being opened which creates the problem that impurities, such as dust, enter through the opening, and the products remaining in the package become less hygienic before being used.

BRIEF SUMMARY OF THE INVENTION

The purpose of this invention is to solve the above-mentioned problems by using a package in which a number of hygienic products, such as disposal diapers, are wrapped as a unit in an inner package, and a number of these inner packages are formed into a unit and wrapped in an outer package. The combination of the inner and outer packages allows the package to hold its shape the outer package is opened.

The outer package is formed by wrapping the inner package unit in a tubular outer wrap, and sealing the top and bottom surfaces. The outer wrap is made of a contractible or heat shrinkable flexible plastic film which is contracted or heat shrunk to maintain and hold the inner package unit in a tightly packed condition. An opening in the outer package is formed by perforation lines in two side panels and a top or bottom panel. The perforation lines may extend the entire height of the outer package. The panel sections between these perforation lines form dust flaps after opening.

The outer package is opened and the inner packages are removed individually.

DETAILED DESCRIPTION

Examples of this invention are explained below with reference to the drawings.

Figure 1:
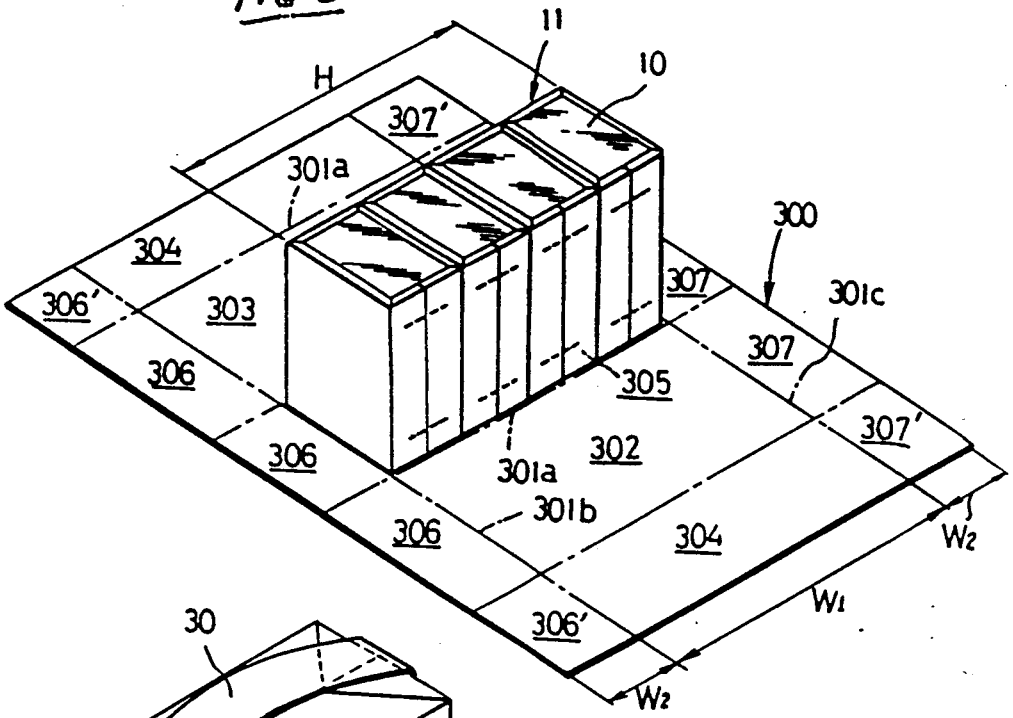
FIG. 1 is an oblique view of the process in a unit of inner packages is wrapped with an outer wrap to form an outer package.
Figure 2:
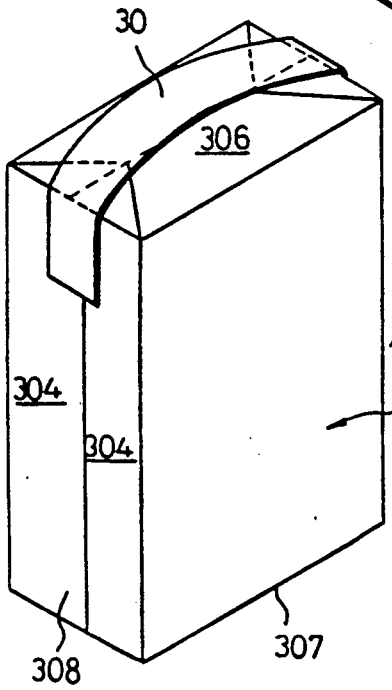
FIG. 2 is an oblique view of a finished outer package.

An outer package 20 is shown in FIGS. 1 and 2. This outer package 20 is formed of outer wrap 300, which wraps a unit 11 that is made by placing a number of the inner packages 10 in a horizontal stack. By wrapping in this manner, outer wrap 300 is divided by folding lines 301*a*, 301*b* and 301*c* into front panel 302, back panel 303, side panels 304, 304 and 305, top panel 306, and bottom panel 307. Again fold lines 301*a*, 301*b* and 301*c* are shown just for illustration, as were the fold lines 202*a*, 202*b* and 202*c* of the inner wrap 201.

A thin flexible plastic film is preferred for outer wrap 300, considering cost savings, and it is preferable for at least top and bottom panels 306 and 307 to be made of a heat-shrinkable film, considering the wrapping procedure. Thus, those types of films are used in the example of this invention. In the event only panels 306 and 307 are to be made of a heat-shrinkable film, this film is connected to the film of panels 302–305.

The packaging of unit 11 by outer wrap 300 is done in the following manner. Panels 302–305 are positioned to face the corresponding surfaces of unit 11, panels 304, 306' and 307' are wrapped around the unit 11 so that the panels of the outer wrap are superposed over their respective faces of unit 11 and panels 304 overlap at 308. The outer wrap 300 is formed into a tubular shape by adhering or linearly fusing (including ultrasonic wave fusion) the panels 304 along overlapping section 308.

Afterwards, panels 306 and 307 forming the top and bottom surface are joined together by the above-mentioned joining means. Next, the heat-shrinkable film forming the panels 306 and 307 are contracted by heat processing. This contraction makes outer wrap 300 tightly cling to unit 11, and offers excellent shape retention properties to all the sides of package 20. A band shaped handle 30 formed of material such as a plastic film is attached to both upper sides of package 20 by the above-mentioned joining means.

If a heat-shrinkable film is used only for the width $W_2$ of panels 306 and 307 and the width $W_1$ of panels 302–305 is approximately the same as height H of unit 11, the contraction of panels 306 and 307 by heat treatment rarely results in the occurrence of wrinkles on panels 302–305 on which the necessary printing was done, but the entire wrap 300 may be made of a heat-shrinkable film.

Figure 3:
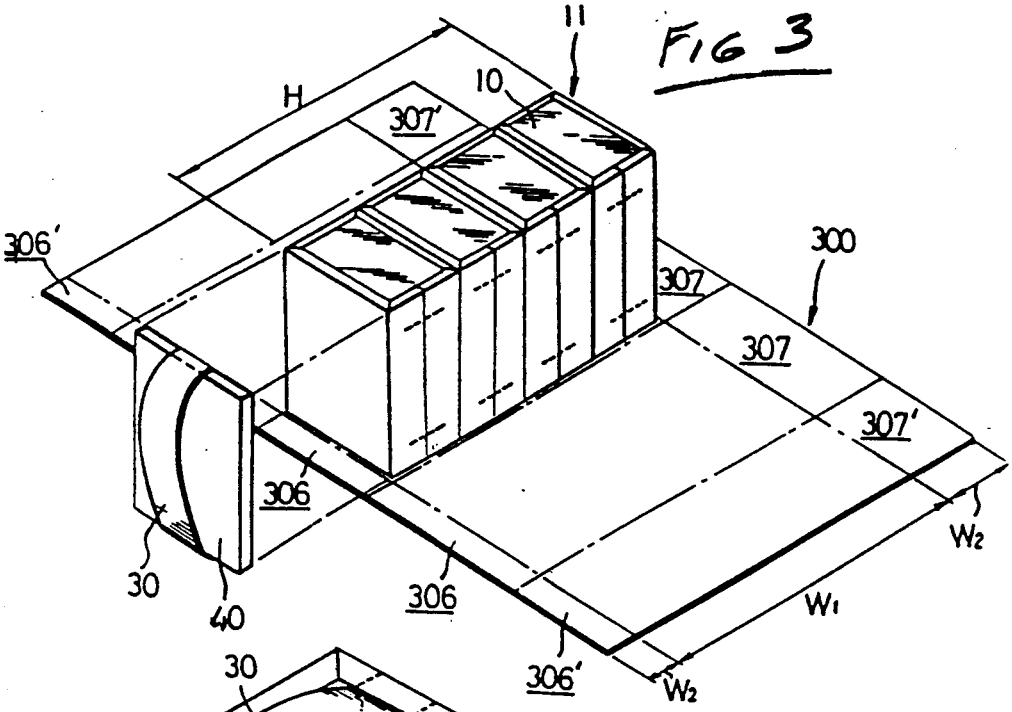
FIG. 3 and FIG. 4 are oblique views similar to FIGS. 1 and 2 showing a modification of the outer package.
Figure 4:
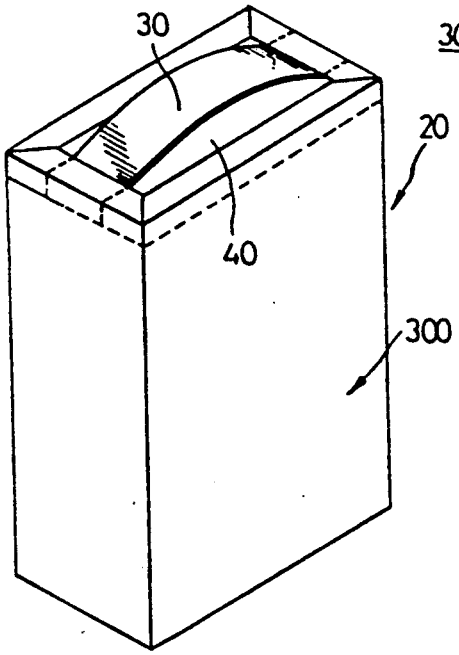
Figure 5:
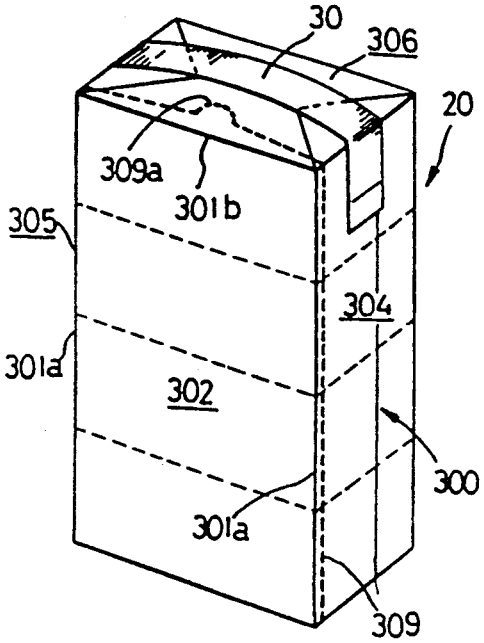
FIG. 5 is an oblique view showing the structure and location of an opening line of perforations in an outer package.

In the modification shown in FIGS. 3 and 4, lid panel 40, on which handle 30 is attached, covers the top surface of unit 11. The lid panel 40 and the unit 11 are then wrapped in outer wrap 300. The width $W_2$ of panels 307 is the same as the width $W_2$ of panels 307 in FIG. 5 and FIG. 6. The width $W_2$ of panels 306 is narrower than the width $W_2$ of panels 306 in FIGS. 1 and 2 because lid panel 40 is used, and panels 306 are attached to the outer edges of the outer face of lid panel 40. Lid panel 40 is made of a material such as paper board, and is made to press down the uppermost package 10 by the thermal shrinkage of panel 306. Also, when inner packages 10 are removed individually from the outer package as will be described later, this lid panel 40, which remains attached to panels 306, functions to prevent the upper surface intrusion of impurities such as dust by covering the upper surface of inner package 10 remaining in outer wrap 300.

In FIGS. 5 to 8, opening perforation lines 309 and 310 are adjacent to edges 301*a* and 301*b* of front panel 302, have arc or H-shaped starting points 309*a* and 310*a* for breaking perforations in the middle of top panel 306, and extend outwardly in both directions from the starting points in top panel 306 and downwardly on panels 309 and 310 to the bottom of panels 309 and 310. Opening perforation line 310 consists of two lines that form a tear tape 315.

Figure 6:
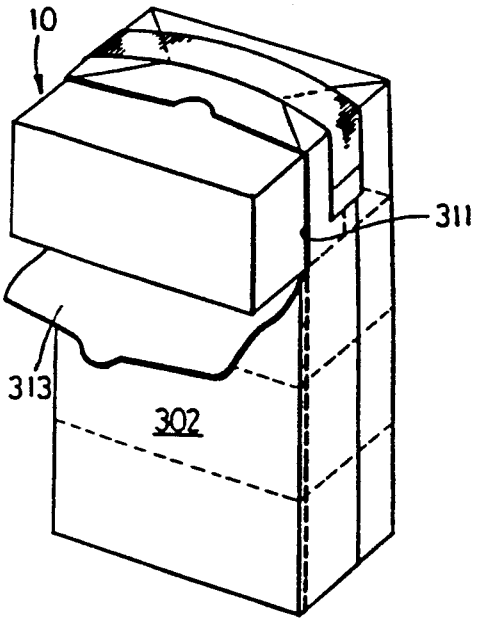
FIG. 6 is an oblique view of the package of FIG. 5 showing the perforation line broken open and an inner package being removed.
Figure 7:
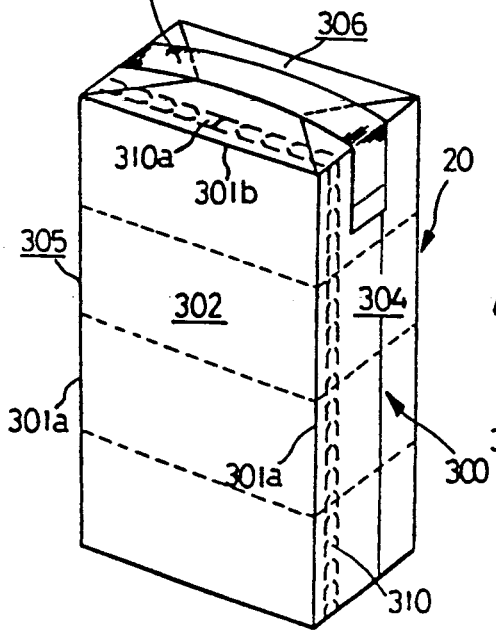
FIGS. 7 and 8, and FIGS. 9 and 10, are oblique views similar to FIGS. 3 and 4 showing modifications in the line of perforations.
Figure 8:
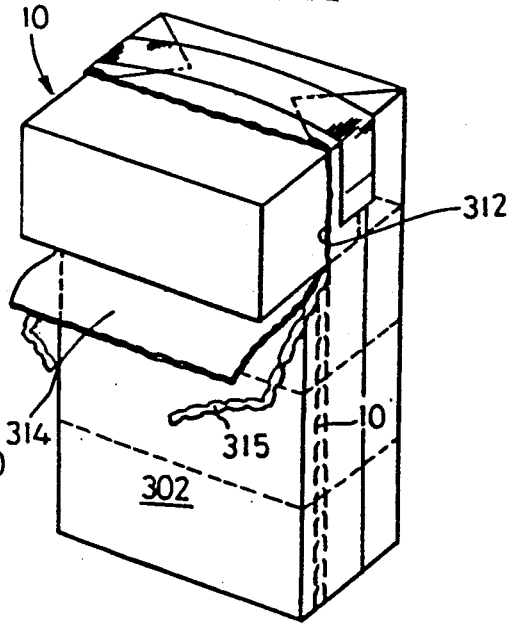

As is shown in FIG. 6 and FIG. 8, outer package 20 is opened by breaking the perforations outwardly and downwardly from starting points 309*a* and 310*a* to form openings 311 and 312 and flaps 313 and 314. Flaps 313 and 314 are folded into outer package 20 after an inner package 10 has been removed, and are used for preventing the intrusion of impurities such as dust.

Figure 9:
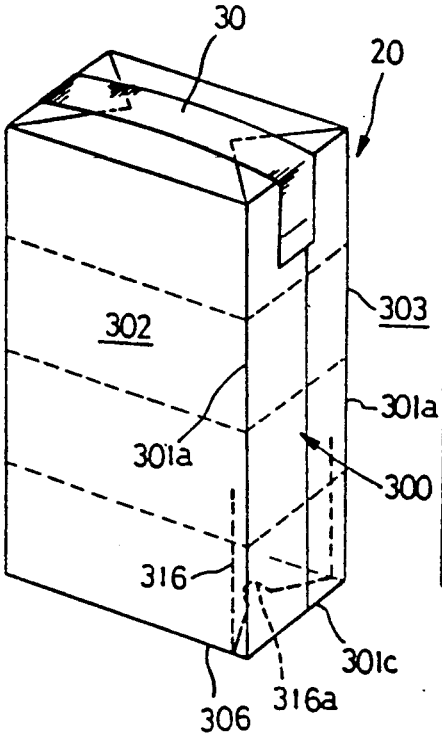
Figure 10:
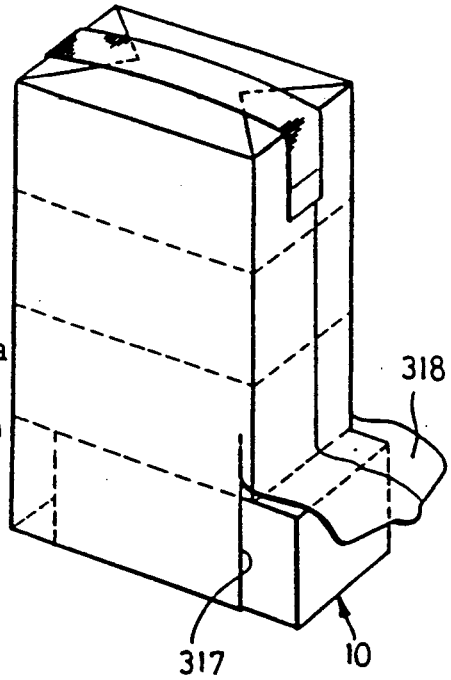

In FIGS. 9 and 10, perforation line 316 extends outwardly from arc-shaped starting point 316*a* on bottom panel 307 and upwardly on front and back panels 302 and 303. It is located close to side edges 301*a* and bottom edge 301*c* of front, back, and bottom panels 302, 303 and 307. As is shown in FIG. 10, outer package 20 is opened by pulling starting point 316*a* of the perforation line upwardly. By this action, opening 317 and flap 318 are formed. This flap 318 also can function in the same manner as flaps 313, 314.

We claim:

1. A package comprising a plurality of inner packages formed into a unit, said unit of inner packages being tightly packed in an outer package, said outer package completely enclosing said unit of inner packages, said outer package comprising a tubular outer wrap forming side panels, and sealed top and bottom panels, and said outer package being made of a flexible plastic film, and only the portions of said film forming said top and bottom panels being of a heat-shrinkable film whereby said unit of inner packages is tightly held when said film is heat shrunk and the occurrence of wrinkles in the side panels is minimized.

2. The package of claim 1 further comprising lines of perforations that extend across one of said top and bottom panels and into a pair of opposed side panels, said lines of perforations when broken defining both an opening in said outer package and a flexible dust flap comprising the side panel between said opposed side panels.

3. The package of claim 2 in which said lines of perforations are adjacent the side edges of said side panel between said opposed side panels.

4. The package of claim 2 in which said lines of perforations extend the height of said opposed side panels.

5. The package of claim 2 in which said lines of perforations being shaped to define a starting point in said one of said top and bottom panels.

6. The package of claim 1 comprising lines of perforation that extend across one of said top and bottom panels and into a pair of opposed side panels, said lines of perforations when broken defining both an opening in said outer package and a dust flap comprising the side panel between said opposed side panels and side flanges on said latter side panel, said lines of perforations being adjacent the side edges of said side panel between said opposed side panels.

said lines of perforations being shaped to define a starting point in said one of said top and bottom panels.

7. The package of claim 6 in which said lines of perforations extend the height of said opposed side panels.

* * * * *